US005938566A

United States Patent [19]

Rodriguez-Ferre

[11] Patent Number: 5,938,566

[45] **Date of Patent: *Aug. 17, 1999**

[54] MODULAR CONSTRUCTION FOR CHILDREN TO PLAY

[76] Inventor: Jose M. Rodriguez-Ferre, c/o Albacete s/rr—Pollgone Industrial Derramador, 05440-Ibi, Spain

[ * ] Notice: This patent issued on a continued prosecution application filed under 37 CFR 1.53(d), and is subject to the twenty year patent term provisions of 35 U.S.C. 154(a)(2).

[21] Appl. No.: 08/664,832

[22] Filed: Jun. 17, 1996

[30] Foreign Application Priority Data

Jun. 30, 1995 [ES] Spain ..... 9501807

[51] Int. Cl.[6] ..... A63B 9/00

[52] U.S. Cl. ..... 482/35; 52/64; 482/36; 446/476

[58] Field of Search ..... 446/476, 478, 446/110, 104; 52/79.5, 270, 284, 64; 482/35, 36

[56] References Cited

U.S. PATENT DOCUMENTS

| | | | |
|---|---|---|---|
| 3,452,498 | 7/1969 | Kinsey | 52/284 |
| 5,121,710 | 6/1992 | Gonzalez | 446/476 |
| 5,313,747 | 5/1994 | Sakihara | 446/478 |
| 5,580,294 | 12/1996 | Briant | 446/476 |

OTHER PUBLICATIONS

Feber 1993 pp. 1,2,3,4,5,6 and 7. Spain NIF. A–03045739. Outdoor collection/1993 Diseno C&D.

TUV product service Juguetes Feber, S.A., Polig. Indust. Derramador, C/O Albacete, SIN P. O. Box 20 IBI (Alicante) Spain NIF A–03045739.

*Primary Examiner*—Jerome Donnelly
*Attorney, Agent, or Firm*—Nixon & Vanderhye

[57] ABSTRACT

An improved modular construction for children to play.

Such comprises modular corner parts (1) including extensions (2) and (3) that form guides for sliding and retaining the edges (4) of modular parts (5) (6) (7) (8) (9) and (10) to form right-angled connections and make up prismatic structures, such parts having a relief imitating dressed stone and an embattled profile (12) that make them appear as a mediaeval castle. The said parts have window (14) and door (13) spaces for the child to gain access into the structure, and raised platforms (34) leading to the outside through a slide (31).

The invention is useful for forming modular constructions designed for children to play, and are mounted without the assistance of means other than those built in the actual parts.

5 Claims, 5 Drawing Sheets

FIG. 2
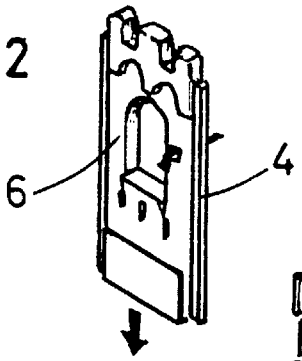
FIG. 3
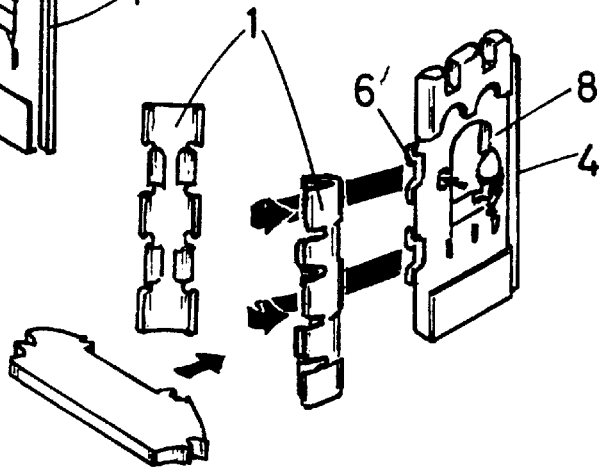
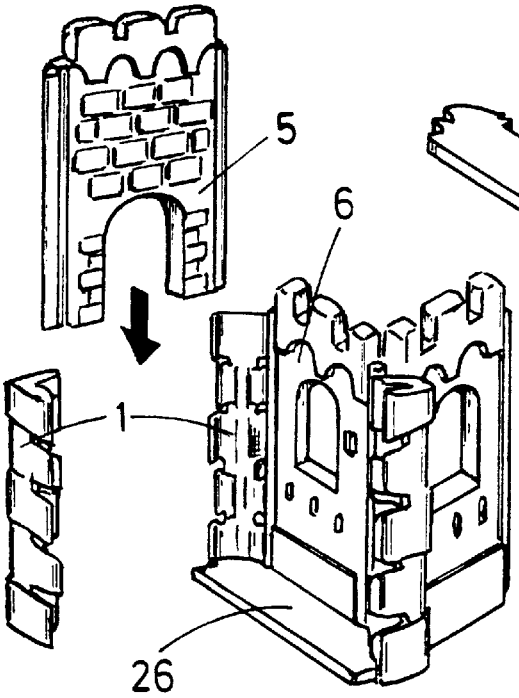
FIG. 4
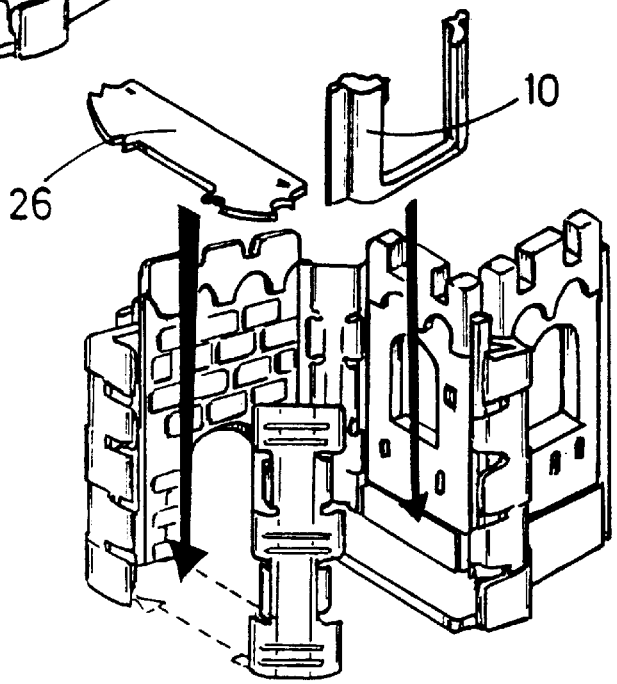
FIG. 5

MODULAR CONSTRUCTION FOR CHILDREN TO PLAY

OBJECT

The present invention relates to an improved modular construction for children to play which, in addition to the function for which it was designed, affords a number of advantages discussed hereinafter, and others that are inherent in its organisation and construction.

BACKROUND OF THE INVENTION

The applicant for the present invention is the holder of Spanish Patent number 9202609 which relates to a structure for children to play which claimed as a novel feature the fact that it comprised a special shape and structure of the parts making it up and the means with which they could be interconnected, by fitting, slipping and/or socketing certain conjugated portions inherent in said parts, which portions were obtained at the moulding stage proper of the main part. These conjugated portions established the relevant substantially firm albeit easily detachable connecting links, allowing a stable and strong structure to be formed, which could be accessed and climbed on by a child when playing, which structure could in turn serve as a support for other auxiliary modular parts making up ladders, slides, platforms and other elements tending to render play more attractive.

The improvements offered by the object of the priority patent lay in doing without traditional auxiliary tie means such as nails, bolts and the like.

The modular parts comprising the patent aforesaid consisted of substantially flattened rectangular shaped bodies made of a moulded material, their working position being vertically upright, and having short extensions of the same material projecting from their longitudinal sides, each extension being curved opposite to the one below, on a different plane, to jointly define vertical guides for axially sliding edges having a round section or a section suited to other parts, thereby to obtain an angular assembly between parts or panels, favouring the construction of regular volumetric bodies.

SUMMARY OF THE INVENTION

The object of the present invention relates to a modular construction obtained using the assembly system covered by the priority patent aforesaid, with which a construction is obtained that is particularly useful for children to play, in which the child has a leading role and is not merely an onlooker.

The special shape and structure of the construction contribute substantial advantages to the development and playing of games, in addition to the advantages derived from the system as such, which, as set out hereinbefore, allows the construction to be easily assembled by an adult and taken apart in due course, whereupon the constituent parts may be kept in a minimum space.

More specifically, modular parts have been devised in the invention subject hereof equivalent to those covered by the priority patent, albeit provided with a specific shape, suited to the desired construction. Now, therefore, such modular parts or panels are provided on either face with a relief imitating stone, thereby making the same appear to be stone walls. The top sides of such parts also have an embattled profile. In this way, the combination of such modular parts allows a construction to be formed which resembles a mediaeval castle, formed by a central prismatic unit, comprising four modular parts in a right-angled arrangement, which include the relevant spaces for full-centre arch doors and windows, which spaces are even additionally provided with closure elements, such as a door leaf fitted with a lock for a key. Several wings open on one side may be attached to the outside of said main body, including raised platforms allowing the child to reach a raised point leading to the outside through the relevant opening in the wall, from which the child may reach the outside ground level with the assistance of a slide or a ladder.

The present invention provides the advantages described above as well as others that will follow easily from the embodiment of a modular construction for children to play described hereinafter in detail for an easy understanding of the features set out above, contemporaneously giving a number of details and attaching to the present specification, to such end, some drawings showing a practical example of the object of the present invention that is meant to illustrate and not to limit its scope.

BRIEF DESCRIPTION OF THE DRAWINGS

In the drawings:

FIGS. 2 to 14 illustrate in perspective the successive mounting stages of the parts leading to the construction being formed altogether.

DESCRIPTION OF A PREFERRED EMBODIMENT OF THE INVENTION

Figure 1:
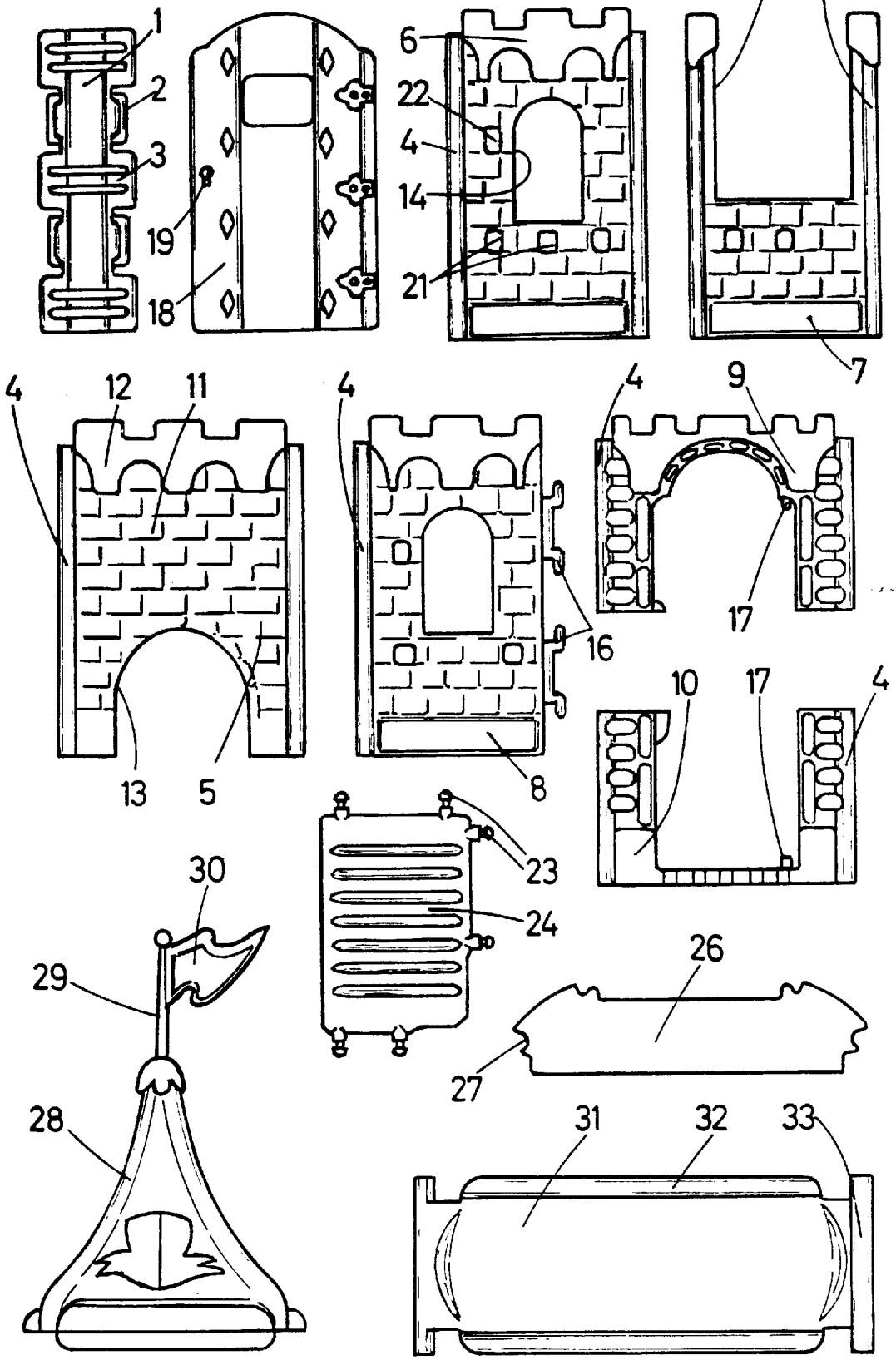
FIG. 1 shows the modular parts altogether making up the construction.

With reference to the figures, the embodiment shows a construction for children to play of a kind comprising modular corner or bevel edge parts 1 having on their vertical longitudinal sides connecting means comprising material extensions 2 and 3 which together form a guide for sliding and retaining the round section edges 4 which border the longitudinal sides of modular parts 5 6 7 8 9 and 10, forming right-angled joints between said parts, making up prismatic, dihedral angle and like bodies, suitable to construct buildings useful for children to play.

The said parts, numbered from 5 to 10 are characterised because their surface has a relief 11 imitating dressed stone, and a top embattled profile 12 that makes such parts resemble the walls of a mediaeval castle. Part 5 is provided with a full-centre arch door 13 whereas parts 6 have a similar full-centre arch window 14. Another part 7 has a rectangular opening 15 on its upper portion and a part 8 has connecting means comprising opposite facing hooks 16.

Parts 9 and 10 complement each other to make up the door space, including spigots 17 that are received in female holes existing in the leaf 18 to form its turning axis, such leaf having a keyhole 19 for a key 20.

Parts 6 7 and 8 have holes 21 and 22. The first holes are designed to receive the male salients 23 for platforms 24 to be fixed, whereas the latter are useful to fix lamp-like appliances 25.

Parts 26 constitute floor portions that help consolidate the structure due to their negative profile 27 with respect to the profile of parts 5 and the like, adapting to such profile because the material gives way elastically, establishing a fit that locks them together.

A part 28 constitutes a top pointed pinnacle extending into a spar 29 carrying a pennant 30.

A rectangular part 31 makes up a sliding platform or slide, to which end it has longitudinal edges 32 serving as handrails and end crosspieces 33 to be fixed in the space of a wall part.

Figure 6:
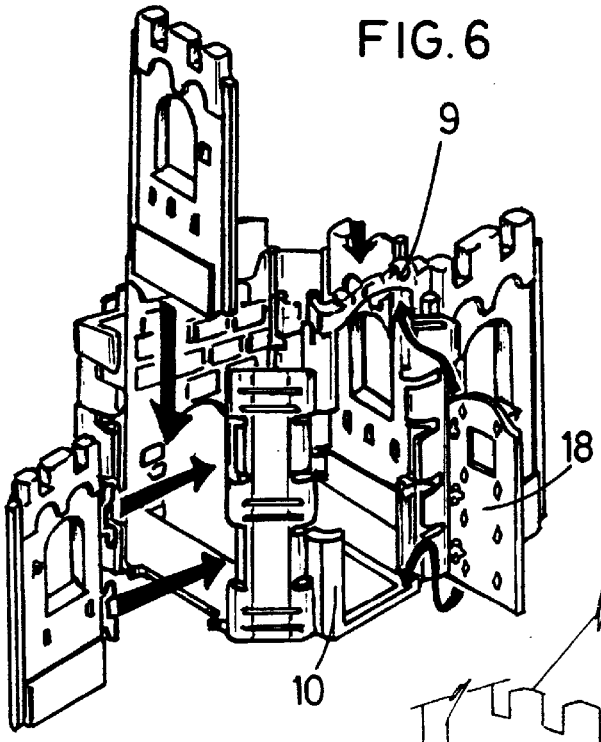
Figure 7:
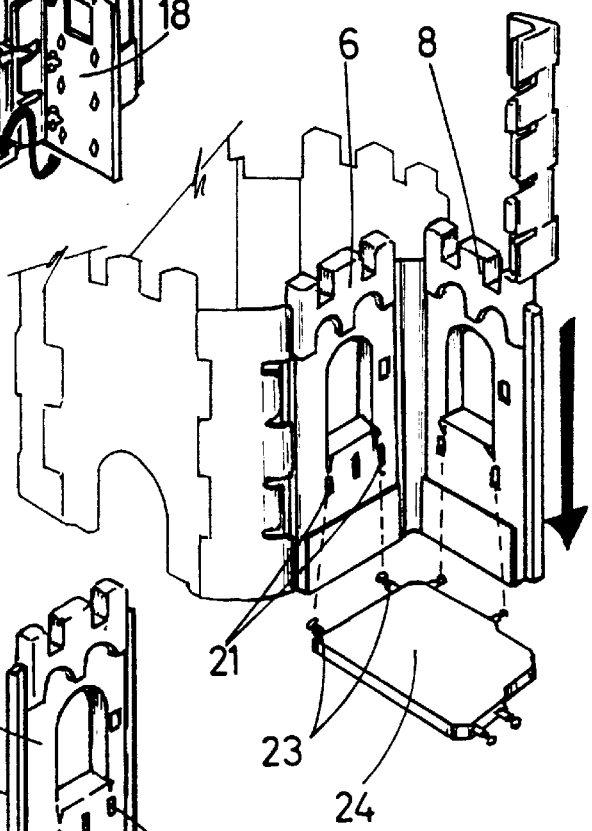
Figure 8:
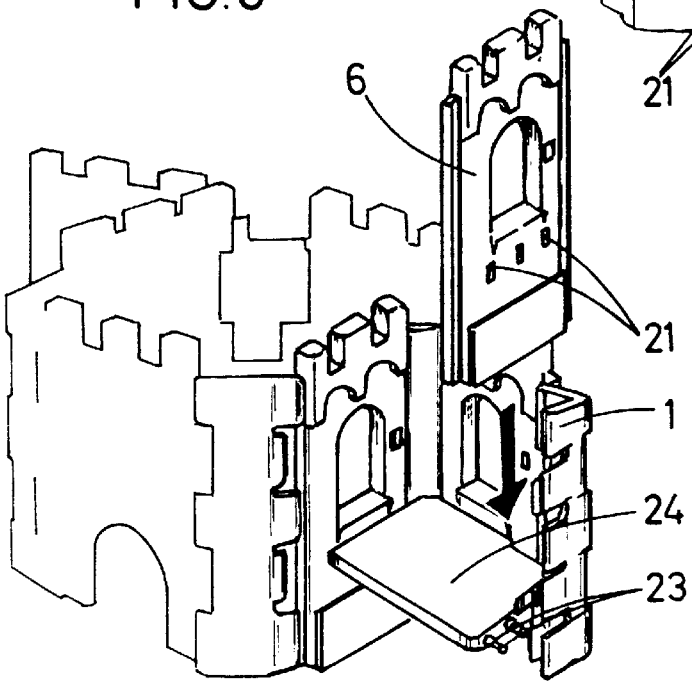
Figure 9:
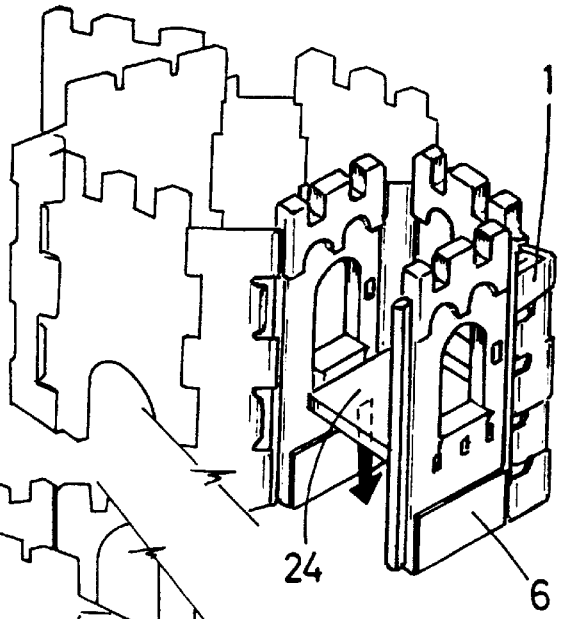
Figure 10:
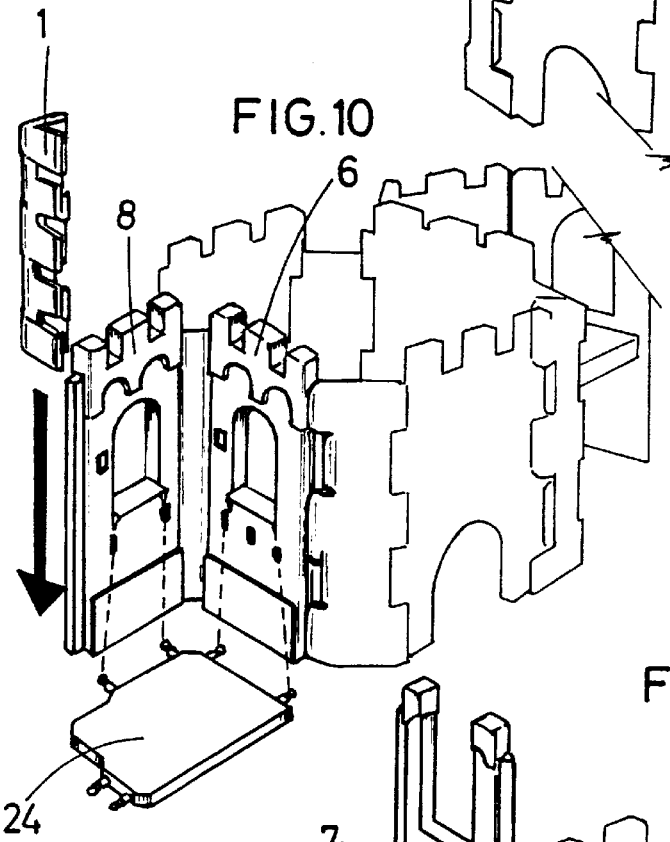
Figure 11:
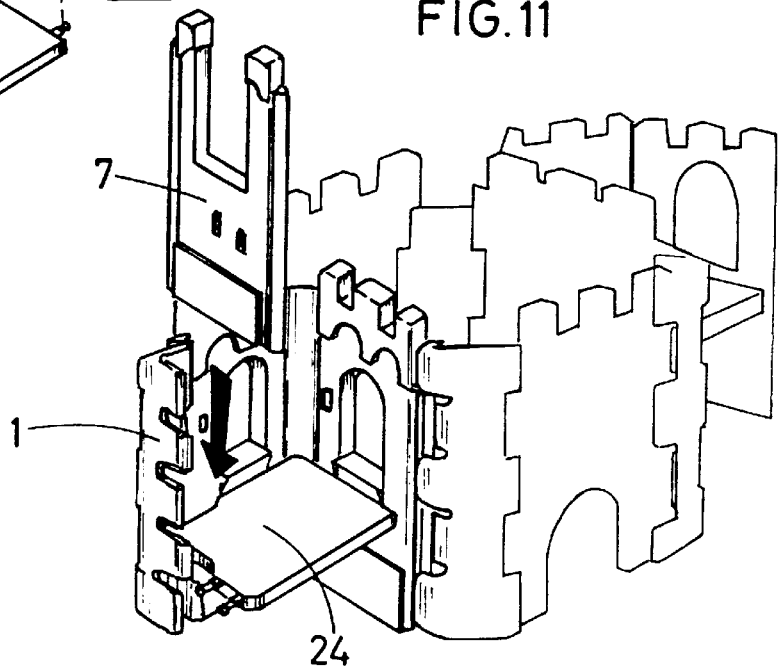
Figure 12:
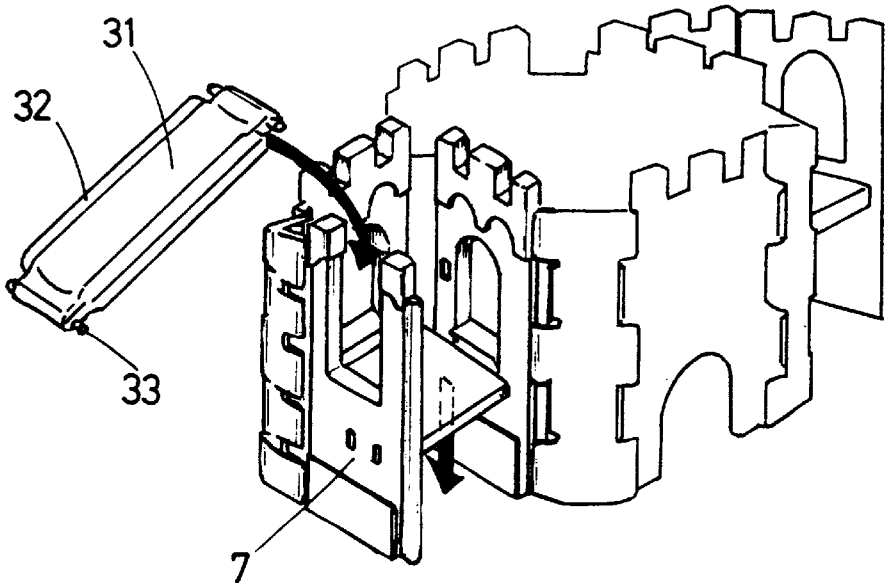
Figure 13:
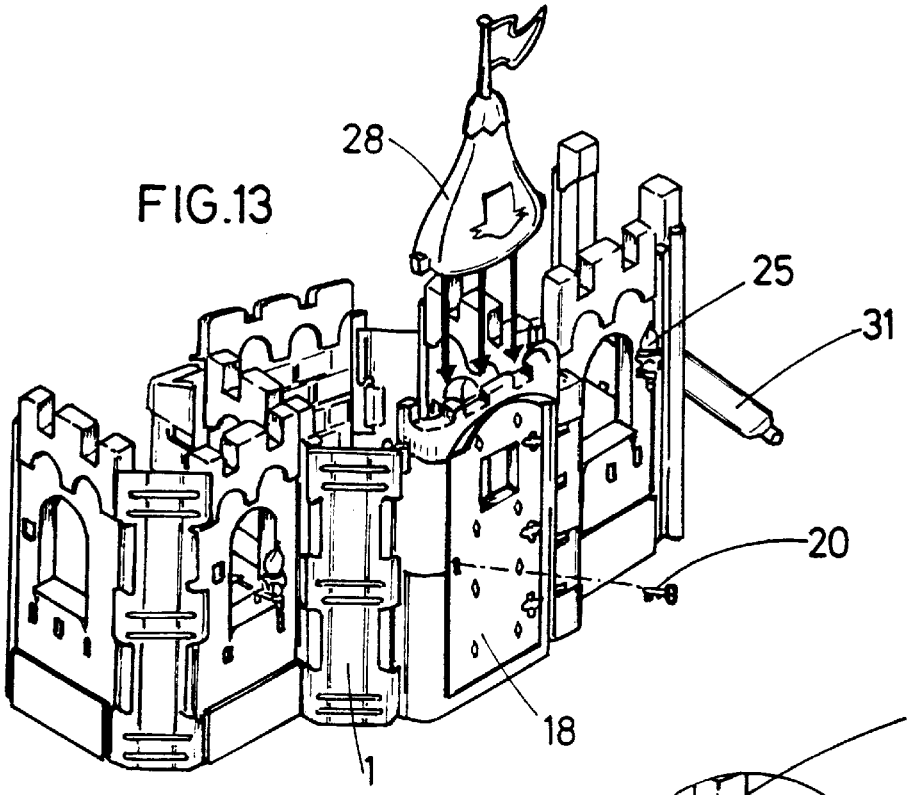
Figure 14:
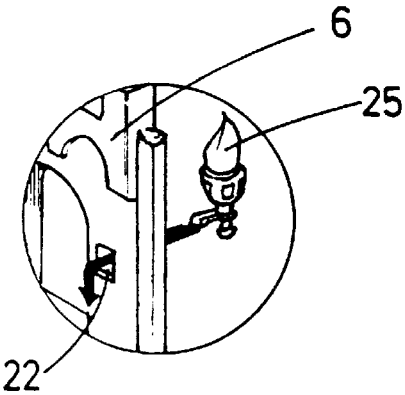

FIGS. 2 to 13 show the successive mounting stages of the construction, in accordance with a simple method, which allows a structure being substantially more than three meters long, more than a meter wide, and more than a meter and seventy centimeters high to be obtained. This structure comprises a central square planed prismatic body generally designated 34 the inside of which can be reached through a door 18. On two opposite sides of this central body 34 two wings are arranged comprised by parts 6 and 8, joined at right angles by the connecting modules 1. Inside such wings lie raised platforms 34 which allow the child to reach up to the height of a window space upon which the top end of the platform or slide 31 is supported.

I claim:

1. A modular play structure for children comprising:

a plurality of modular parts including corner parts and flattened, vertically extending generally rectangular parts, said corner parts having discrete extensions spaced from one another along opposite sides thereof forming vertically extending edge guides, said flattened parts having vertically extending elongated edges for reception within said guides, enabling four of said flattened parts to be joined with at least three of said comer parts with the elongated edges of the flattened parts slidably vertically received within said guides of said corner parts to substantially form an enclosed structure;

certain of said flattened parts having on surfaces thereof a relief simulative of dress stone for simulating the wells of a medieval castle and a generally toothed profile along upper edges thereof simulative of embattlements on said walls of the medieval castle;

at least one of said flattened parts comprising a pair of generally U-shaped segments, one of said segments being inverted and disposed on another of said U-shaped segments to define a door space, said segments having door leaf mounts for pivotally mounting a door leaf within said door space;

at least one floor plate of a generally trapezoidal profile having a contoured edge complementary to the edges of the flattened parts for imparting stability to the castle when the modular parts are assembled to form the castle.

2. A structure according to claim 1 wherein said flattened parts have openings therethrough delineated along upper sides thereof by arches and constituting door and window spaces for the castle.

3. A structure according to claim 1 wherein a number of said flattened parts have a plurality of openings therethrough at elevations therealong above lower edges of said number of flattened parts, said module parts including a platform module having projections for reception in said openings for supporting said platform module at said elevation and from said number of said flattened modules.

4. A structure according to claim 1 wherein said flattened parts have openings therethrough delineated along upper sides thereof by arches and constituting door and window spaces for the castle, wherein said plurality of modular parts include an elongated rectangular part with raised longitudinally extending edges, a crosspiece at each of the opposite ends of said elongated part, one of said crosspieces being receivable within said window space and releasably fixed to said flattened part defining said window space for projecting from the window space downwardly and outwardly for use as a slide.

5. A structure according to claim 1 wherein said module parts include a pair of wings for releasable attachment at corners for projecting outwardly of said structure, one of said modules comprising said flattened module having an opening therethrough delineated along upper sides thereof by an arch and constituting a window space for the wing, and a platform supported by said wings at an elevation adjacent a lower edge of said window space.

* * * * *